United States Patent [19]

Helmick

[11] 4,064,863

[45] Dec. 27, 1977

[54] ARROW REST

[75] Inventor: James C. Helmick, Grayling, Mich.

[73] Assignee: Victor United, Inc., Chicago, Ill.

[21] Appl. No.: 694,938

[22] Filed: June 11, 1976

[51] Int. Cl.[2] ..... A41B 5/00

[52] U.S. Cl. ..... 124/41 A; 33/265

[58] Field of Search ..... 124/41 A, 21 R, 20 B, 124/25, 88, 41 R, 20 A; 33/265

[56] References Cited

U.S. PATENT DOCUMENTS

| | | | |
|---|---|---|---|
| 3,292,607 | 12/1966 | Hoyt | 124/24 R |
| 3,672,347 | 6/1972 | Allen | 124/41 R |
| 3,760,788 | 9/1973 | Hartman | 124/24 R |
| 3,871,352 | 3/1975 | Stanislawski et al. | 124/24 R |

*Primary Examiner*—Richard C. Pinkham
*Assistant Examiner*—William R. Browne
*Attorney, Agent, or Firm*—Emory L. Groff, Jr.

[57] ABSTRACT

An arrow rest for an archery blow includes a base plate having a rear surface attachable to a bow side and a front surface provided with a vertical rib having an outer surface spaced from the plate front surface and engageable by the lateral periphery of an arrow shaft. A vertically disposed flap having a depth substantially greater than its width, of resilient or elastomeric composition, having a rear base portion attached to the plate front surface and a main body section extending outwardly and forwardly in a curved manner and adapted to support the lower periphery of an arrow shaft. The top of the flap is provided with a concave surface serving to cradle the arrow shaft and biases the arrow shaft so as to force it into engagement with the rib's outer surface both during the draw and release of the arrow as the flap body is deflected rearwardly and forwardly respectively, from its normal at-rest position.

9 Claims, 4 Drawing Figures

ARROW REST

This invention relates generally to an archery accessory, and more particularly, to an improved arrow rest readily attachable to the side of an archery bow.

Present day archery bow construction usually includes a center hand grip section above which is provided a sight window bounded at its lower portion by a horizontal shelf serving as the arrow supporting and guiding surface during the draw and release of the bow. Several disadvantages may become apparent when shooting a bow having the basic construction as referred to above. Bow shooters have discovered that an arrow supported only by the rigid shelf below the sight window is normally deflected around the sight window and also tends to bounce during its release, thereby producing an erratic flight. Additionally, the arrow fletching is subjected to damage by its repeated passage over the subjacent arrow shelf and adjacent bow side surface.

Various devices have been provided in the past in an effort to preclude the referenced erratic flight and fletching damage, and the arrow rest of the instant invention has been conceived as an improvement over known such devices. Arrow rests comprising a disparate member either releasably or fixedly attached to a bow side in the area of the sight window have been available for many years, yet many of these fall far short of solving the problems enumerated hereinabove. Preferably, the arrow supporting portion of an arrow rest should comprise a deflectable member automatically displaceable upon the release of the arrow. Previous solutions in this area have comprised the use of bristles or a pivoted vane for supporting the arrow shaft, and although these members may certainly be considered to be deflectable, they have often been found to provide inadequate support and guidance for the arrow shaft during its draw and release and the inherent rigidity of these vanes has still resulted in noticeable damage to the arrow fletching.

Many earlier endeavors have included a multi-part assembly of intricate metallic or other rigid components which are acknowledged to be expensive to manufacture, require at least occasional adjustment and/or maintenance and are often readily damaged if struck by a foreign object. Another shortcoming voiced particularly by game hunters has been the noise attendant with use of many existing arrow rests.

Accordingly, one of the primary objects of the present invention is to provide an improved arrow rest comprising a molded unitary device having a flexible arrow supporting and guiding flap integral with the balance of the rest and constructed of an inherently resilient material.

A further object of the present invention is to provide an improved arrow rest comprising a unitary member having a vertical arrow side guiding rib presenting a limited contact surface with an arrow shaft and disposed above and adjacent to a curved arrow bottom supporting and guiding flap of resilient material and integral with the balance of the arrow rest.

Still another object of the present invention is to provide an improved arrow rest of one-piece construction and including a resilient arrow bottom supporting and guiding flap having a convex outer surface and a concave upper arrow supporting surface.

Another object of the present invention is to provide an improved arrow rest including a base plate having a fixed raised arrow shaft side engaging rib and an elastomeric arrow bottom engaging flap disposed below said rib and having a rear portion affixed to the base plate behind said rib and a forward end normally disposed ahead of and spaced from said rib.

With these and other objects in view which will more readily appear as the nature of the invention is better understood, the invention consists of the novel construction, combination and arrangement of parts hereinafter more fully described, illustrated and claimed.

A preferred and practical embodiment of the invention is shown in the accompanying drawing in which.

Similar reference characters designate corresponding parts throughout the several figures of the drawing.

Figure 1:
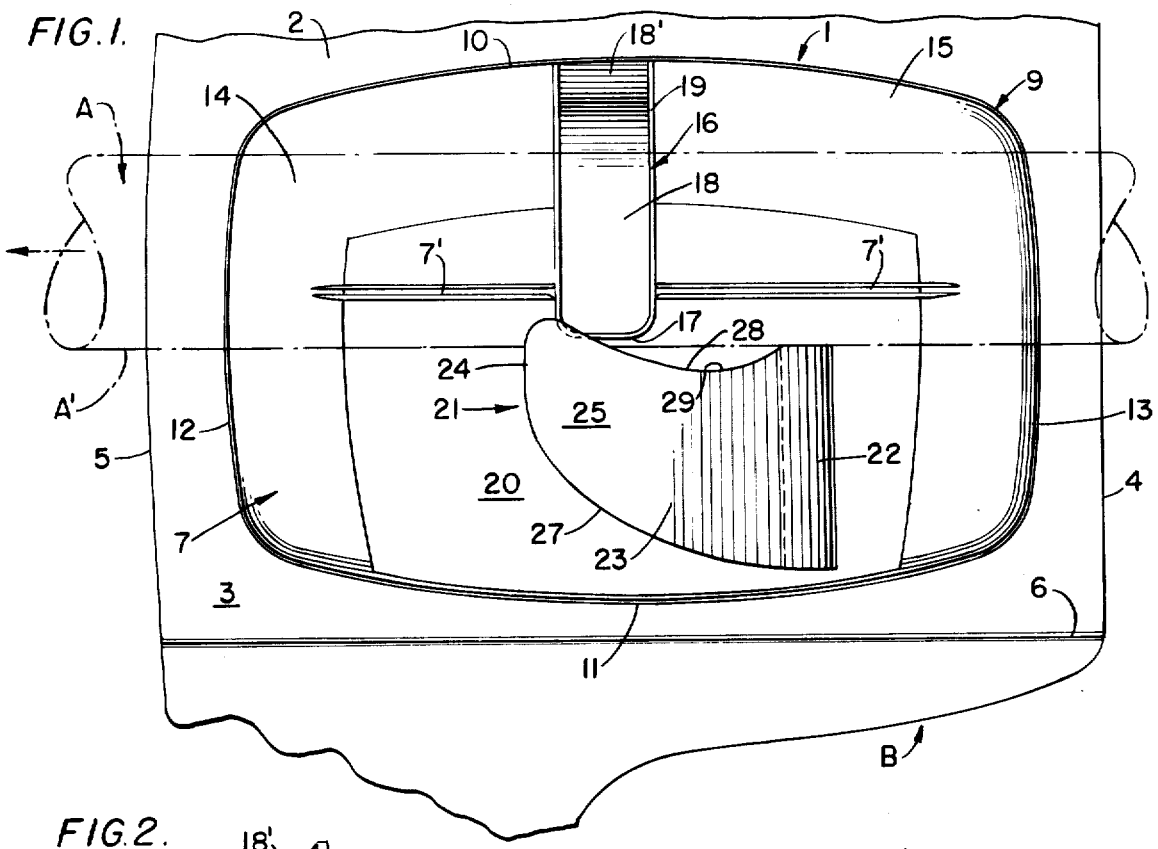
FIG. 1 is a side elevation of the arrow rest of the present invention affixed to a bow.

Referring now to the drawing, particularly FIG. 1, the arrow rest, generally designated 1, will be seen to be affixed to the side 2 of an archery bow B in the area of the sight window 3 and intermediate the bow face 4 and bow back 5 at a point immediately above the horizontal arrow shelf 6. Preferably the entire arrow rest 1 is fabricated from an inherently elastomeric or resilient material such as rubber or any other suitable composition which may conveniently be molded to provide an integral construction. The base plate 7 of the arrow rest is provided with a substantially planar rear or attachment surface 8 adapted to be affixed to the side 2 of the bow B in the desired position relative the arrow supporting shelf 6. Any suitable means may be employed to provide a permanent or semi-permanent attachment of the plate 7 to the bow B, such as contact adhesive. To facilitate orientation of the arrow rest relative the designed horizontal shooting axis of the bow sight window 3, alignment means are provided on the plate 7 and may comprise any suitable indicia such as the horizontally disposed grooves 7' which may be readily formed during molding of the rest 1. In this manner the grooves 7' may be aligned parallel to the shooting axis to ensure proper orientation of the arrow rest during its attachment to the bow B.

The outer periphery 9 of the base plate 7 generally defines a rectangular configuration, and is preferably constructed with a slightly outwardly curved top edge 10, bottom edge 11, front edge 12 and rear edge 13 as shown most clearly in FIG. 1 of the drawing. The outer or front surface 14 of the base plate 7 is bounded by a convexly curved border 15 immediately adjacent the outer periphery 9 and a combination of this curved border 15 and the curved outer periphery 9 will be understood to enhance the retention of the arrow rest 1 in its attachment to the bow side 2 as such configuration discourages abrupt engagement by arrow fletching or any other object thereagainst which may otherwise tend to catch or pull the base plate 7 away from the bow side.

Projecting from the upper portion of the arrow rest at a point adjacent the intermediate area of the top edge 10 is a vertically disposed arrow side or lateral guide rib generally designated 16. This rib extends downwardly from the top edge 10 to a point adjacent the medial height of the base plate 7 and terminates in a bottom edge 17 to define a vertically extending flat outer surface 18 which will be seen to be substantially raised or spaced from the surrounding outer surface 14 of the base plate, as shown most clearly in FIG. 2 of the drawing. The uppermost area of the rib 16 is provided with a curved top portion 18' leading to the top edge 10, while the sides and bottom of the rib are provided with a beveled periphery 19 serving to preclude any abrupt engagement between the fletching of an arrow and portions of the arrow rest. At this point it should be understood that the arrow shaft lateral engaging rib 16 is stationary relative the base plate 7. Prior reference to construction of the entire arrow rest from a resilient composition is not to convey the impression that the rib is compressible or that its outer surface is deflectable during any part of its use or function.

The central portion of the base plate outer surface 14, in an area extending from the rib flat outer surface 18 to the base plate bottom edge 11, is formed with a flat surface 20 and overlying this latter surface is the flap, generally designated 21, which serves as the arrow shaft bottom support and guiding member during the draw and release of the arrow.

As previously mentioned, the entire arrow rest 1 is preferably molded to provide an integral or one-piece construction, and accordingly it will be understood that the flap 21 is not a separate component merely pivotally attached, such as by a hinge, to the base plate 7, but rather is preferably formed integral therewith and is joined to the flat plate surface 20 by means of a vertical base portion 22.

The flap 21 will be seen to comprise a vertically disposed main body section 23 projecting outwardly from the vertical base portion 22 and terminating in a free end 24 directed toward the forward edge 12 of the arrow rest and includes a convexly curved outer side surface 25 and concavely curved inner side surface 26. The arrow rest, when constructed, is formed such that the flap 21 is disposed in the position shown in the drawing when at the at-rest condition, that is, the flap will be disposed in a self-sustaining manner with the free end 24 thereof positioned forward of the vertical guide rib 16 and spaced well away from the juxtaposed flat plate surface 20 with the distal portion of the outer side surface 25 located a distance from the flat outer surface 18 of the rib which is slightly beyond the outer portion of the arrow shaft periphery A'. The bottom of the flap 21 is preferably formed with a convex lower surface 27, while the top thereof is formed with the concave upper arrow rest surface 28, having its lowest point 29 located intermediate the vertical base portion 22 and free end 24. More specifically, the lowest point 29 is provided at a location which will always be inside the point of tangency between the shaft periphery A' and flap upper surface 28. From a review of FIG. 2 it will thus be evident that the radius of the shaft A is greater than the lateral distance between point 29 and the plane of the rib surface 18 for reasons which will become obvious hereinafter.

Figure 2:
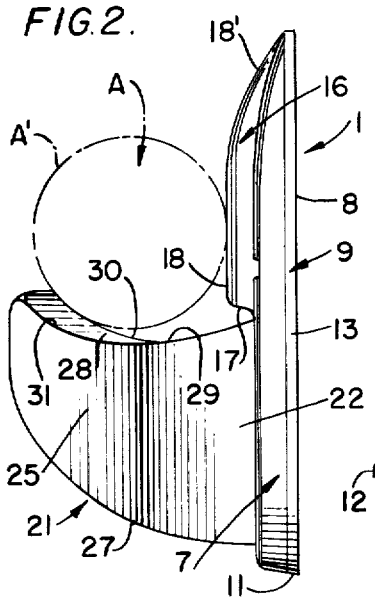
FIG. 2 is a rear elevation of the arrow rest as shown in FIG. 1.
Figure 3:
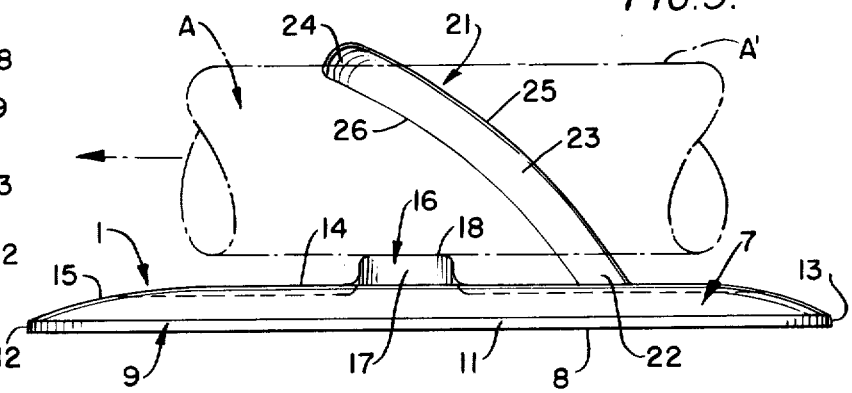
FIG. 3 is a bottom plan view of the arrow rest of FIG. 1.
Figure 4:
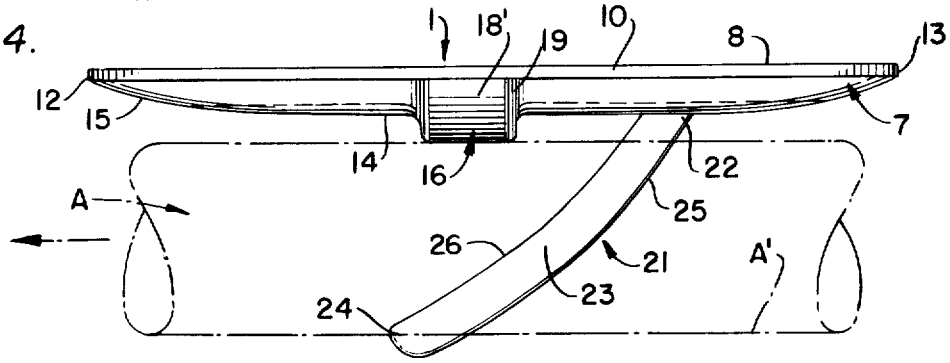
FIG. 4 is a top plan view of the arrow rest of FIG. 1.

The upper arrow rest surface 28 may be provided with an inner edge 30 which is defined by either a different radius than the adjacent outer edge 31 or wherein the radii of these two edges have their locus at different points such that the upper arrow rest surface 28 is tilted downwardly from its inner edge 30 towards its outer edge 31 as shown most clearly in FIG. 2 of the drawing. This construction has been found to facilitate injection mold design and removal of the molded part. Additionally, it will be seen that when an arrow shaft A is disposed upon the flap 21 of the arrow rest 1, its periphery A' will primarily tend to engage or be contacted by the inner edge 30, rather than the entire extent of the upper arrow rest surface 28, thereby reducing the amount of surface contact between the arrow shaft periphery A' and flap 21, both during the draw of the arrow as well as during its release.

The operation of the aforedescribed arrow rest 1 will now be readily appreciated when it is understood that an arrow positioned upon the upper arrow rest surface 28 of the flap 21 will automatically be cradled thereupon and urged by both the curvature of the upper surface 28 and the curvature of the flap body section 23 toward engagement with the outer surface 18 of the vertical arrow lateral guide rib 16. With an arrow shaft A at rest as shown in the figures of the drawing, gravity acting upon the arrow shaft as it is supported on the top of the flap 21 will ensure full seating of the arrow shaft as shown most clearly in FIG. 2 of the drawing, and it will follow that as the arrow shaft is drawn rearwardly frictional engagement between its periphery A' and the concave upper arrow rest surface 28 of the flap will positively urge the arrow shaft periphery against the vertical rib 16 as the arrow shaft moves rearwardly and its periphery tends to partially deflect the flap 21 rearwardly. Upon the subsequent release of the arrow shaft the same concavity of the upper arrow rest surface 28 of the flap 21 tends to maintain constant engagement between the arrow shaft periphery A' and the fixed vertical guide rib 16 as the shaft moves forwardly, during which time the frictional engagement between the flap upper arrow rest surface 28 and the arrow shaft periphery will urge the flap 21 forwardly with its inner side surface 26 being directed closer to the flat plate surface 20 until the fletching has passed the arrow rest.

With the above construction in mind it will be appreciated that by providing the highest point 29' of the flap 21 at a plane which is substantially above the lowest point 29, the arrow shaft will at all times be cradled upon the flap and urged into contact with the rib 16 whether the flap is in an at-rest position, is being deflected rearwardly or is being urged forwardly to a partially collapsed position.

I claim:

1. An arrow rest for attachment to an archery bow including, a base plate having a front surface and a rear attachment surface, said rear surface engageable with a bow surface whereby said base plate remains a stationary member with said front surface fixedly disposed relative thereto, a stationary guide rib on the upper portion of said front surface and provided with a fixed outer surface spaced outwardly from said plate front surface extending generally vertical downwardly from the uppermost edge of the base plate, a flap means of resilient material having a rear portion fixedly attached to the lower portion of said plate front surface at a point disposed rearwardly of said guide rib and including a forwardly extending main body section provided with a free end, said flap means when in an at-rest position angularly disposed relative to said base plate with said free end spaced away from and forwardly of the vertical plane of said guide rib, said flap means being of substantial depth as compared to its width at the area where the flap means attaches to the base plate, and said flap means being provided with an concave uppermost arrow shaft supporting surface juxtaposed said guide rib whereby an arrow shaft disposed upon said rest is supported upon its lower periphery by said flap means supporting surface and the lateral periphery of an arrow is biased into engagement with said rib outer surface by said flap means, and rearward drawing of an arrow frictionally displaces said resilient flap means rearwardly from its at-rest position while forward release of an arrow frictionally displaces said resilient flap means forwardly past its at-rest position with said flap means returning to its at-rest position after passage of an arrow over said flap means said entire arrow rest being of a one piece integrally molded resilient construction.

2. An arrow rest according to claim 1 wherein, said plate, rib and flap are molded of elastomeric composition to provide a unitary construction.

3. An arrow rest according to claim 1 including, a curved border on said front surface adjacent the periphery of said base plate.

4. An arrow rest according to claim 1 wherein, said flap means section is provided with a convexly curved outer surface and a concavely curved inner surface.

5. An arrow rest according to claim 1 wherein, said arrow shaft supporting surface is concavely curved.

6. An arrow rest according to claim 5 wherein, the lowest point of said flap concavely curved shaft supporting surface is disposed from said rib outer surface a distance less than the radius of an arrow shaft supported thereon.

7. An arrow rest according to claim 5 wherein, said flap shaft supporting surface is inclined downwardly and rearwardly.

8. An arrow rest according to claim 1 wherein, said alignment means includes a groove.

9. An arrow rest for attachment to an archery bow including, a base plate having a front surface and a rear attachment surface, horizontally disposed indentation alignment means on said plate front surface extending the general direction of an in-place arrow and providing visual angular orientation of said plate when said plate rear surface is attached to a bow, a guide rib on the upper portion of said front surface and provided with an outer surface spaced outwardly from said plate front surface, a flap means of resilient material having a rear portion fixedly attached to the lower portion of said plate and including a forwardly extending main body section provided with a free end, said flap means when in an at-rest position angularly disposed relative said bases plate with said free end spaced from the vertical plane of said guide rib, said flap means provided with an uppermost arrow shaft supporting surface whereby an arrow shaft disposed upon said rest is supported upon its lower periphery by said flap means supporting surface and the lateral periphery of the shaft is biased into engagement with said rib outer surface by said flap means, and rearward drawing of an arrow frictionally displaces said resilient flap means rearwardly from its at-rest position while forward release of an arrow frictionally displaces said resilient flap means forwardly past its at-rest position with said flap means returning to its at-rest position after passage of an arrow over said flap means.

* * * * *